US009242284B2

(12) United States Patent
Umlauf

(10) Patent No.: US 9,242,284 B2
(45) Date of Patent: Jan. 26, 2016

(54) METHOD AND APPARATUS FOR STRAIGHTENING METAL BANDS

(71) Applicant: Norbert Umlauf, Hagen (DE)

(72) Inventor: Norbert Umlauf, Hagen (DE)

( * ) Notice: Subject to any disclaimer, the term of this patent is extended or adjusted under 35 U.S.C. 154(b) by 127 days.

(21) Appl. No.: 13/836,089

(22) Filed: Mar. 15, 2013

(65) Prior Publication Data

US 2014/0260481 A1 Sep. 18, 2014

(51) Int. Cl.

| | |
|---|---|
| ***B21D 1/06*** | (2006.01) |
| ***B21D 1/05*** | (2006.01) |
| ***B21C 1/30*** | (2006.01) |
| ***B21C 47/00*** | (2006.01) |
| ***B21B 38/02*** | (2006.01) |
| ***B21B 39/08*** | (2006.01) |
| ***B65H 23/10*** | (2006.01) |
| ***B65H 20/06*** | (2006.01) |
| ***B21C 47/34*** | (2006.01) |

(52) U.S. Cl.

CPC . *B21D 1/05* (2013.01); *B21B 38/02* (2013.01); *B21B 39/08* (2013.01); *B21C 1/30* (2013.01); *B21C 47/00* (2013.01); *B21C 47/006* (2013.01); *B21C 47/3458* (2013.01); *B65H 20/06* (2013.01); *B65H 23/10* (2013.01)

(58) Field of Classification Search

CPC ..... B21D 1/05; B21B 38/02; B21B 39/08; B21C 1/30; B21C 47/00; B21C 47/006; B21C 47/3458; B65H 20/06; B65H 23/10

USPC ..... 72/164

See application file for complete search history.

(56) References Cited

U.S. PATENT DOCUMENTS

| | | | | |
|---|---|---|---|---|
| 2,033,423 | A * | 3/1936 | Frank | 72/224 |
| 2,569,266 | A * | 9/1951 | Thompson | 72/422 |
| 2,642,280 | A * | 6/1953 | Fisk | 72/419 |
| 2,920,755 | A * | 1/1960 | Talbot | 72/302 |
| 4,000,636 | A * | 1/1977 | Shubin et al. | 72/307 |
| 4,141,679 | A * | 2/1979 | Asano et al. | 72/256 |
| 4,982,593 | A * | 1/1991 | Holloway | 72/302 |
| 6,205,830 | B1 * | 3/2001 | Voges | 72/302 |

FOREIGN PATENT DOCUMENTS

| | | |
|---|---|---|
| WO | WO-0027554 A1 | 5/2000 |
| WO | WO-2005035158 A1 | 4/2005 |

OTHER PUBLICATIONS

Umlauf, N., "Neues Brems- und Zuggerüst—ein Mechanik-Linearantrieb für Walzwerke und Bandanlagen", Sonderdruck aus "Stahl und Elsen" 110 (1990), Heft 2, Seite 103-107.

* cited by examiner

*Primary Examiner* — David B Jones

(74) *Attorney, Agent, or Firm* — Panitch Schwarze Belisario & Nadel LLP

(57) ABSTRACT

The invention may relate, among other things, to a device for straightening a metal strip having two strip drives which are suitable together to apply tension on the metal strip to straighten the metal strip, wherein at least one of the strip drives is a linear drive, characterized in that the at least one linear drive has a positioning device such that the linear drive can be moved relative to the longitudinal axis of the device.

19 Claims, 6 Drawing Sheets

METHOD AND APPARATUS FOR STRAIGHTENING METAL BANDS

The present invention relates to a device for straightening a metal strip having two strip drives which are suitable together to apply tension on the metal strip to straighten the metal strip, wherein at least one of the strip drives is a linear drive.

Devices for straightening metal strips are used in rolling and processing lines for metal strips. Metal strips are straightened for various purposes. For example, one case of application may be to improve the geometry and the flatness of the metal strips. Alternatively or additionally, the purpose of straightening may be to change certain mechanical properties of the metal strip with the deforming associated with the straightening, such as the yield strength or the break resistance.

Stretch-bend-straightening lines for straightening metal strips are known which have S-roller drives on the inlet side and the outlet side suitable to impose a tension to the strip, between which a bending stand is arranged with a plurality of bending rollers through which the metal strip passes. The stretch-bend-straightening to manufacture metal strips with defined flatness is then achieved from the interaction between strip tension and bending. The bending rollers are normally kept as small as possible in order to keep the strip tension imposed by the bending rollers as low as possible. This leads to residual stresses being introduced into the straightened metal strip which are subsequently released, worsening the geometry and the flatness of the strips once again. The pair of rollers for the S-roller drives which cause the build up and release of the strip tension also lead to a measurable worsening in the strip quality for each redirection. Therefore, for example, only strips straightened by stretching are used for heavily loaded components in aircraft construction, which however have to be manufactured in a discontinuous manner.

In the article "Neues Brems-und Zuggerüst—ein Mechanik-Linearantrieb für Walzwerke und Bandanlagen" by Leonhart Puppel, Klaus Bielefeld and the applicant, Norbert Umlauf, published in Verlag Stahleisen mbH, "Stahl und Eisen" 110 (1990), Number 2, pages 103 to 107, a mechanical linear drive is suggested which can be used instead of the S-roller drive in order to avoid the above mentioned disadvantage. The article also describes that for certain tasks it can be useful to assemble the linear drive in a compact manner and then only to straighten the metal strip under tension without a curving unit. A stand with an upper and a lower chain driven system with rubberised driver plates is described as a linear drive, which driver plates run in parallel over a certain distance. The metal strip is tensioned and transported between the driver plates running parallel. The drive is linear, by which, unlike with an S-roller drive, the metal strip is not bent.

Examples of linear drives suitable to linearly apply a driving force to a metal strip in a contact-based or in a contactless manner are further known from WO 00/27554 A1 and WO 2005/035158 A1.

The object of the invention is to provide a device for straightening with which it is possible to improve the geometry and the flatness of the metal strip as compared with straightening with conventional straightening equipment.

This object may be achieved by a device having features as recited in various accompanying claims.

A linear drive is taken to mean any device which is suitable to linearly apply a tensile force on a metal strip, which tensile force is sufficient to stretch the metal strip to its yield strength and beyond. For example, the linear drives described in WO 00/27554 A1 and WO 2005/035158 A1 with which metal strips can be driven or braked without bending the metal strip, in a contact-based or contactless manner, are suitable.

At least one of the linear drives comprises a positioning device with which it is possible to adjust the position of the linear drive relative to the longitudinal axis of the straightening device. Thus, it is possible to control the position of the metal strip in the straightening device. In particular, it is possible to position the centre or an edge of the strip exactly relative to the longitudinal axis of the straightening device. This optimises the straightening result. At the same time, the strip can be fed exactly positioned into a subsequent processing procedure in a metal strip processing system.

In one embodiment of the invention, the positioning device of the at least one linear drive is such that the transport axis of the linear drive can be set at an angle to the longitudinal axis of the straightening device. Therewith, it is possible to build up a different strip tension over the width of the metal strip. In this way, the strip tension can be controlled over the width of the strip. This means that for example in a strip with a thickness increasing from one side to the other, the thickness of the strip can be adapted by a greater tensile force being applied on the thicker side of the strip. In sabre-like metal strips which are slightly bent in the plane of the strip, a higher strip tension is applied to the side of the metal strip with the smaller radius of curvature in order to counteract the curvature of the strip (the sabre).

To this end, the linear drive which is provided with a positioning device is preferably movably mounted with a frame within an assembly frame, wherein at least one guide is provided on the assembly frame, which guide interacts with at least one guide element which is rigidly connected to the frame of the linear drive such that the linear drive is movable relative to the assembly frame on a guided path. It has proven to be particularly effective if the guided path is a circular path.

In an also preferred further embodiment of the invention, the two strip drives each have a positioning device.

In an embodiment according to the invention the two strip drives are a linear drive on the inlet side and a linear drive on the outlet side. With a device of this type, the metal strip can exclusively be loaded with tension and therefore straightened, wherein the at least one positioning device serves to position the metal strip exactly in the straightening device and/or to distribute the strip tension differently over the width of the metal strip in order, for example, to compensate for a strip sabre.

Each of the linear drives can in a further embodiment of the invention be movable on a circular path, wherein the centre of the circle in the direction of movement of the strip can lie in front of the linear drive in each case.

In a further embodiment of the invention a strip tension measuring device is provided between the linear drives to measure the strip tension, in order that the tensile force applied to the metal strip can be controlled during straightening. Preferably, the strip tension is determined with the strip tension measuring device over the width of the metal strip. An integrated strip tension measuring system can be provided for this purpose, which measuring system records the reaction forces from the strip tension in a linear manner on each side of the linear drive very precisely. The measuring data determined by the strip tension measuring device can be used to control the positioning devices.

Alternatively or additionally, the device according to the invention can have at least one measuring device to determine one or a plurality of properties of the metal strip(s), in particular to determine its cross section, its waviness and/or its position. The measuring data determined by the measuring device can also be used to control the positioning device(s).

If the strip is brought into a defined position by means of the positioning device of the linear drive on the inlet side, a position determination for the strip behind the linear drive on the outlet side can be used to control the correction of the strip sabre, since a right/left deviation of the strip permits the conclusion that the metal strip is sabre-shaped.

In principle, the flow path of the strip should be kept as short as possible in the straightening device. The strip drives should therefore be as close to one another as possible.

However, it is also possible to influence the position and length of the flow path by the metal strip being deformed in a targeted manner between the strip drives and the metal strip by rolling or bending. The flow path is then limited to the stretch in which the sheet experiences targeted deforming.

To this extent, a viable embodiment of the invention is to arrange a roll stand between the strip drives, wherein the roll pass determines a flow line during straightening. As the position of the sheet is determined in the roll stand, it is useful if the two linear drives are then pivoted on a common circular path and the centre of the circular path is in the middle of the roll gap.

In a similar manner, at least one bending roller can be provided between the linear drives.

The above mentioned object of the invention is also achieved by a device for straightening a metal strip having a linear drive on the inlet side and a linear drive on the outlet side, which are suitable together to apply tension on the metal strip to straighten the metal strip, which is characterised in that a deforming stand is arranged between the linear drives. The deforming stand can in particular be a rolling mill stand or a bending stand. Here there is an improvement over the known prior art in that, as already mentioned, the flow path can be influenced during the straightening process in a targeted manner by the rolling of the rolling mill stand or bending roller of the bending stand, in particular can be shortened.

The object of the invention is further achieved by a method for straightening a metal strip with a linear drive on the inlet side and a linear drive on the outlet side, which is characterised in that the linear drive on the inlet side and/or the outlet side is/are positioned depending on the position or one or a plurality of properties of one or a plurality of the metal strips relative to one another.

It is also seen as a useful embodiment of the method if the linear drive on the inlet side and/or the linear drive on the outlet side is/are each pivot on a circular path depending on the position or one or a plurality of properties of the metal strip. The advantages of this method are outlined in the description above.

The object of the invention is further achieved with a method for straightening a metal strip having a linear drive on the inlet side and a linear drive on the outlet side and a deforming stand arranged therebetween, characterised in that the tensile force applied by the linear drives to the metal strip is at least 99% of the 0.2% tensile yield strength×the transverse section of the metal strip and the deformation applied by the deforming stand to the metal strip is less than 1%, wherein the deforming stand can be a roll stand or a bending stand.

The invention is described below using figures in which preferred exemplary embodiments of the invention are shown schematically in greater detail:

Figure 1:
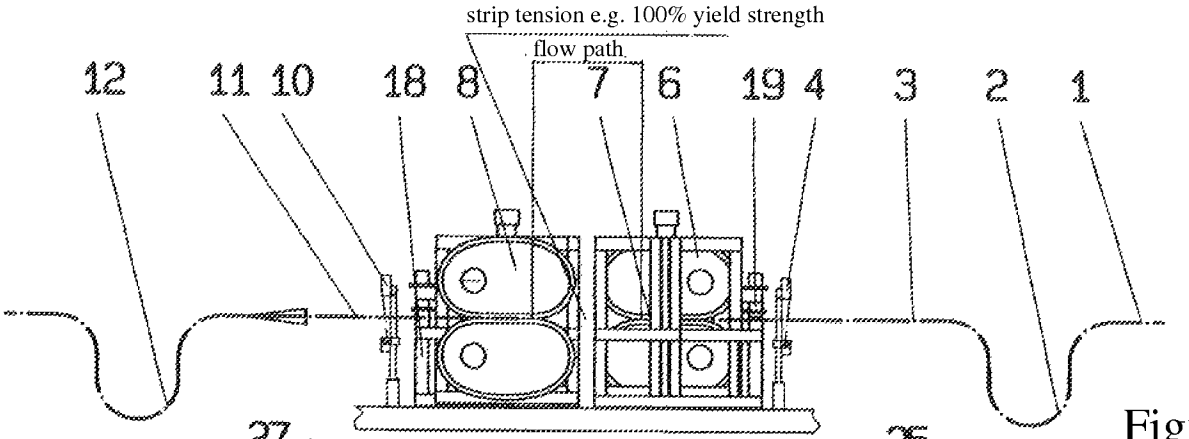
FIG. 1 is a side view of a system for stretch straightening metal strips by means of strip tension in an operating position.
Figure 2:
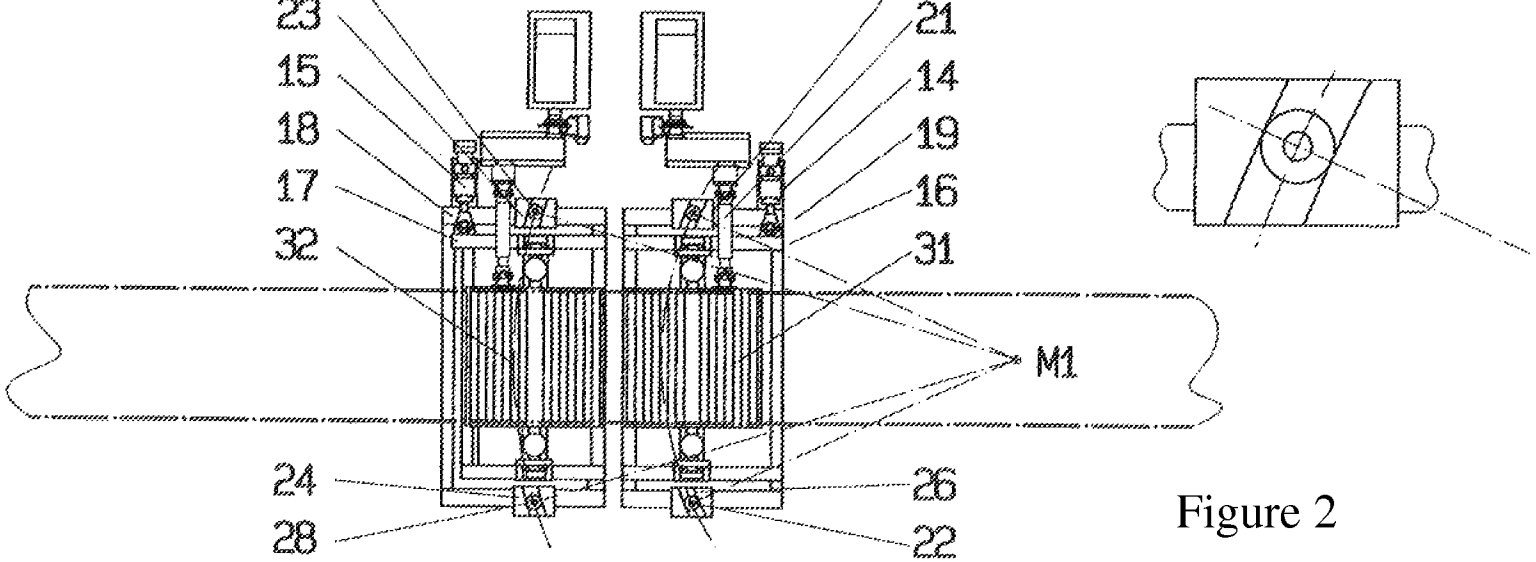
FIG. 2 is a top view of the system in FIG. 1.

FIGS. 1 and 2 show a continuous system for stretch straightening a hot rolled or cold rolled metal strip. This straightening system has a linear drive 6 on the inlet side and a linear drive 8 on the outlet side for stretching a metal strip 1. The linear drives 6 and 8 are each equipped with a strip guiding system. The strip guiding system of the linear drive on the inlet side has an assembly frame 18, a positioning cylinder 14 and a measuring device 4 arranged in front of the linear drive 6 in the direction of movement of the strip 11 for determining the position of the strip. The strip guiding system for the outward linear drive 8 has an assembly frame 19, a support cylinder 15 and a measuring device 10 arranged behind the linear drive 8 in the direction of movement of the strip 11 for determining the position of the metal strip 1. The measuring device 10 can, as with measuring device 4, also have a means to determine the flatness and the sabre of the metal strip 1.

The linear drives 6 and 8 are mounted such that they can be moved independently from one another relative to the longitudinal axis of the system by operating the respective positioning cylinders 14, 15. For this purpose, the frames 16, 17 of each of the linear drives 6, 8 are each movably mounted in the positioning frames 18, 19. For example, the frames of the linear drives 16, 17 can be mounted on the positioning frames 18, 19 by means of plain bearings on respective bearing blocks (roller bearings could also be used). Guides 21, 22, 23, 24 are provided on each of the assembly frames 18, 19. Guide rollers 25, 26, 27, 28 engage in these guides 21, 22, 23, 24, which guide rollers are movable in the guides 21, 22, 23, 24 and are rigidly connected to the frames 16, 17 of the linear drives 6, 8. The positioning cylinders 14, 15 are pivotably coupled to the frames 16, 17 of the linear drives 6, 8 and aligned such that they can act on the frames 16, 17 of the linear drives 6, 8 in a direction transverse to the longitudinal axis of the system. In this way, a linear drive 6, 8 can be guided on a path predetermined by the guides 21, 22, 23, 24 by actuating one of the support cylinders 14, 15.

The interacting guides 21 and 22 as well as 23 and 24 of each of the assembly frames 18, 19 are preferably on a circular path 31, 32. In the present exemplary embodiment, the two circular paths 31, 32 have the same centre of the circle M1 which is, with respect to the direction of movement of the strip 11, upstream of the linear drive 6 on the central longitudinal axis of the straightening system. The pivot radius of the linear drive 8 is therefore larger than that of linear drive 6.

The guides do not necessarily have to describe a section of the circular path, it is sufficient if they are straight and run substantially in parallel to a circular path.

In one embodiment, the guides could alternatively extend completely transverse to the longitudinal axis of the system such that the linear drive is exclusively displaceable transverse to the longitudinal axis of the system.

The guides may in particular be arranged adjustably such that various circular paths or an angle between the guiding path and the longitudinal axis of the system can be set. If the pivot radius is larger then a finer strip guiding system is possible, if it is smaller then the position can be corrected or the tensile force distribution over the width of the strip can be corrected more rapidly.

With the strip guiding system, it is optionally possible to guide the metal strip 1 directly over the centre of the system axis (strip centre control), or to exactly guide one of the edges of the metal strip 1 for the straightening process or subsequent processes (strip edge control).

With the exemplary embodiment shown it is possible to guide the centre of the metal strip 1 on the central longitudinal axis of the system or an edge of the metal strip parallel to the central longitudinal axis of the system with an accuracy of less than 1 mm in each case. Furthermore it is possible to achieve that with a sabre-like metal strip the shorter side of the strip experiences a higher strip tension than the longer side. In this area, the additional stretching on the short side of the strip leads to a reduction of the sabre. Through targeted overstretching, the sabre can be kept in a wave shape with low tolerances.

The flow path identified in FIG. 1 is the part of the metal strip 1 between the linear drives 6, 8 which is not gripped by the linear drives 6, 8. In the example shown, this is as short as possible in order to achieve as even a material flow as possible during stretching in the flow path.

Mounted in front of the linear drive 6 on the inlet side in the direction of movement 11 is a pair of rollers (not shown) for the provision of a strip loop 2 in order to feed the metal strip 1 into the linear drive 6 on the inlet side in a substantially tension-free manner. An inspection unit (not shown) is provided between the strip loop 2 and the linear drive 6 on the inlet side, the position of which inspection unit is identified by the number 3. The inspection unit can be used to measure the flatness and the geometry of the metal strip 1. Mounted behind the linear drive 8 on the inlet side in the direction of movement of the strip 11 is a further pair of rollers (also not shown) for the provision of a strip loop 12 in order to also keep the metal strip 1 tension free on the outlet side.

The strip loops 2, 12 have the advantage that the strip measurement in the inspection unit and in the measuring devices 4 and 10 can be carried out without flawed influences.

A measurement of the strip tension applied to the strip by the linear drives 6 and 8 is carried out by means of measurement cells (not shown) in which the reaction forces from the strip tension is recorded. Since there is no distortion of the measurements through deflection rollers as there is in conventional stretch/curving straightening systems, the strip tension measurement is very accurate. Measuring can be carried out for the left-hand and right-hand sides of the strip separately. Since the position of the strip is very carefully regulated, the difference in the strip tensions can be used to assess a strip sabre and to automatically correct the strip sabre.

The results of the strip measurement in the inspection unit 3 can be used in addition to the results of the measurement of the position of the strip in the measuring devices 4, 10 in order to set the position of the linear drives 6 and 8 using the strip guiding system.

The condition of the strip in terms of the geometry and flatness can be recorded on the inlet side for example by means of flatness measuring rollers or camera systems or other measurement systems on the tension-free strip. In this way, in particular the measurements of the inspection unit 3 and/or the measuring device 4 can be used to adapt the values for the strip tensions to be applied by the linear drive 8 on the outlet side and/or the braking forces to be applied by the linear drive 6 on the inlet side and therefore the resulting level of stretching, which is generally predetermined in the metal sheet production process. Values for controlling the position of the linear drives 6, 8 relative to one another can also be determined using these measurement values. In order to regulate the tensile and braking forces and the position of the linear drives relative to one another, the measurement values determined by the measuring device 10 for the position, flatness and sabre-like nature of the straightened metal strip 1 serve in particular to make it possible to correct the previously determined control values. A flatness measuring roller or a camera system could also be used for this. Information on the level of stretching can also be provided from the measurement data on the outlet side, or the predetermined regulating variables are corrected on the basis of these measurement data.

In this exemplary embodiment, the strip tension is set such as to achieve straightening of the strip by only using tension. The straightening of the strip is carried out at very strip tension, up to about 100% of the yield strength or 0.2% of the yield point of the strip material or even more. The straightening of the strip is carried out in relation to evenness and shape (strip sabre). The correction of a strip sabre can be achieved in a targeted manner by means of one or two strip guiding systems.

While the strip in the exemplary embodiment shown in FIGS. 1 and 2 is only straightened or stretched by strip tension, FIGS. 3 to 12 show exemplary embodiments of devices according to the invention in which the deformation is achieved through the strip tension and an additional deformation by means of rolling or bending the sheet.

Figure 3:
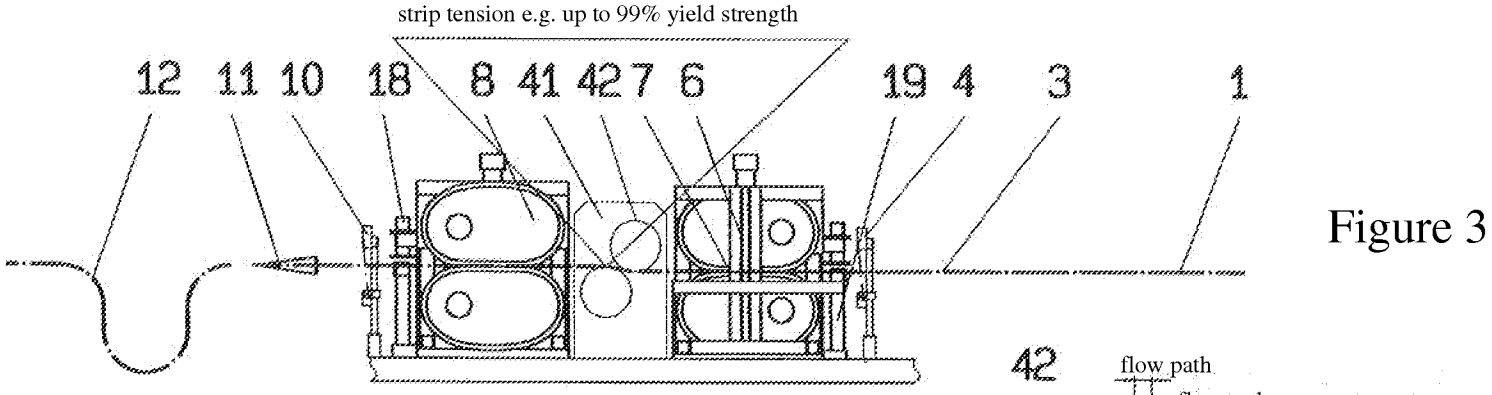
FIG. 3 is a side view of a system for stretch-bend-straightening metal strips by means of strip tension and large bending rollers as flow rollers in an operating position.
Figure 4:
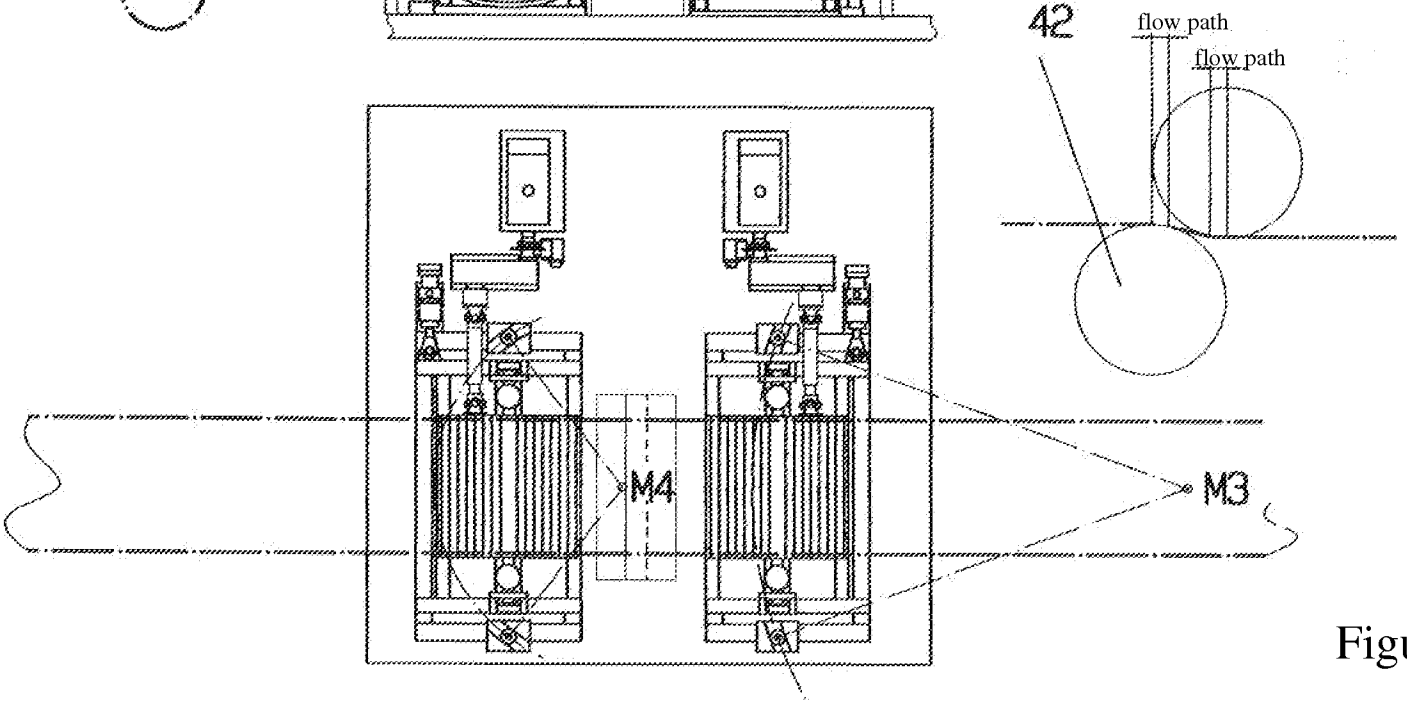
FIG. 4 is a top view of the system in FIG. 3.

A further exemplary embodiment according to the invention is shown in FIG. 3 and FIG. 4, which exemplary embodiment is similar to the exemplary embodiment in FIGS. 1 and 2. As in the exemplary embodiments described hereafter, parts of the system which have the same function as the corresponding part of the exemplary embodiment in FIGS. 1 and 2 are indicated with the same number. Only the differences between this exemplary embodiment and the exemplary embodiment described above will be addressed below.

In this exemplary embodiment, the distance of the linear drives 6 and 8 from one another is greater. A bending stand 41 is provided between the linear drives 6 and 8, through which bending stand the metal strip 1 is guided. The bending stand has two bending rollers 42 which are arranged consecutively in the direction of movement of the strip having a hard surface and a large diameter, of which one is arranged above and the other below the metal strip 1, such that the bending effect of the bending rollers 42 on the metal strip 1 is low. The curving rollers ensure that the flow of the material takes place on two short flow paths, namely substantially only in the areas in which the bending rollers act on the metal strip (as shown in FIGS. 3 and 4). As a result, the flow path can be shortened relative to that of the previously described exemplary. At the same time, only a low level of residual stress results from the size of the bending rollers and the associated large bending radius. A ratio of bending roller diameter to strip thickness of 500 or more is ideal.

The contact area between metal strip and the bending roller (or flow roller) can be kept very small.

In this example, as an example, the strip tension can be derived from the transverse section area of the strip×99% of the 0.2% tensile yield strength. The flow of the strip is regulated by linear drive 6. A sabre reduction is achieved at the same time. The bending rollers 42 offer a fixed point in the straightening path between the linear drives 6 and 8. The deformation of the metal strip 1 to reduce the sabre is thereby facilitated. Again, in case of a sabre-like metal strip, a considerably higher strip tension is applied by the linear drives 6, 8 to the shorter side of the strip. This increased specific strip tension leads to an additional stretching during stretch straightening with almost no adverse effects owing to an additional stretch-bend straightening on the bending rollers or to an additional material flow through strip tension and overlaid bending.

Deviating from the exemplary embodiment 1, the linear drives are not pivotable about the same pivot point but rather the linear drive 6 on the inlet side about a central point M3 and the linear drive 8 on the outlet side about a central point M4, wherein the two central points in the direction of movement of the strip 11 are each in front of the linear drive and the pivot radius is considerably greater for the linear drive 6 than the pivot radius for the linear drive 8.

An immersion depth of the bending rollers into the path of the metal strip is set according to the information input for how high the percentage of deformation by bending should be in the straightening process. It is ideal if the percentage of deformation by curving to the overall deformation generated during straightening is less than 10%. In this exemplary embodiment, the strip tension is typically set such that around 99% of the desired straightening level is achieved and the remaining 1% of the desired straightening level is carried out by the bending rollers. This means that the aim is not for the metal strip to be straightened by bending but rather to generate a precisely defined short flow path through the area of bending where the metal strip 1 contacts the bending rollers.

Figure 5:
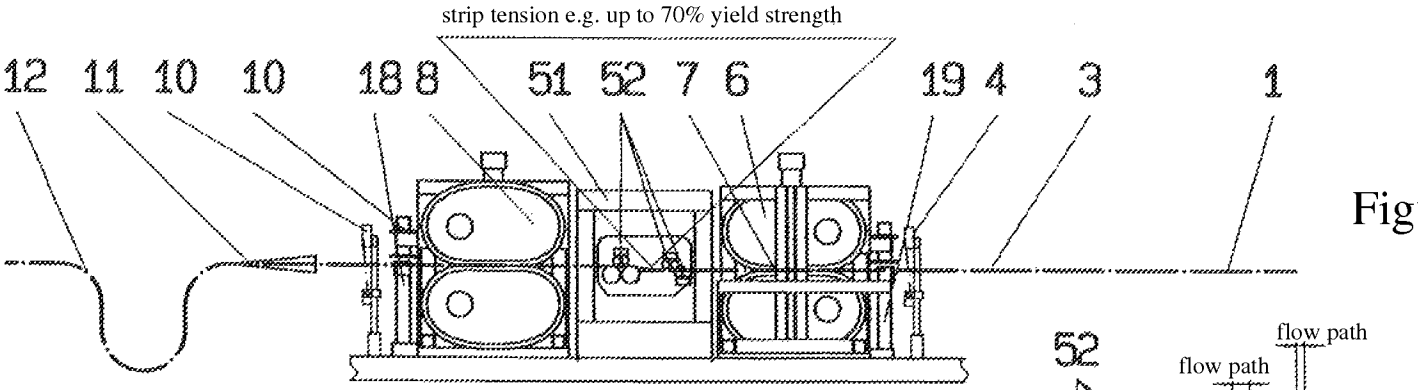
FIG. 5 is a side view of a system for stretch-bend-straightening metal strips by means of strip tension and small deflection rollers as flow rollers in an operating position.
Figure 6:
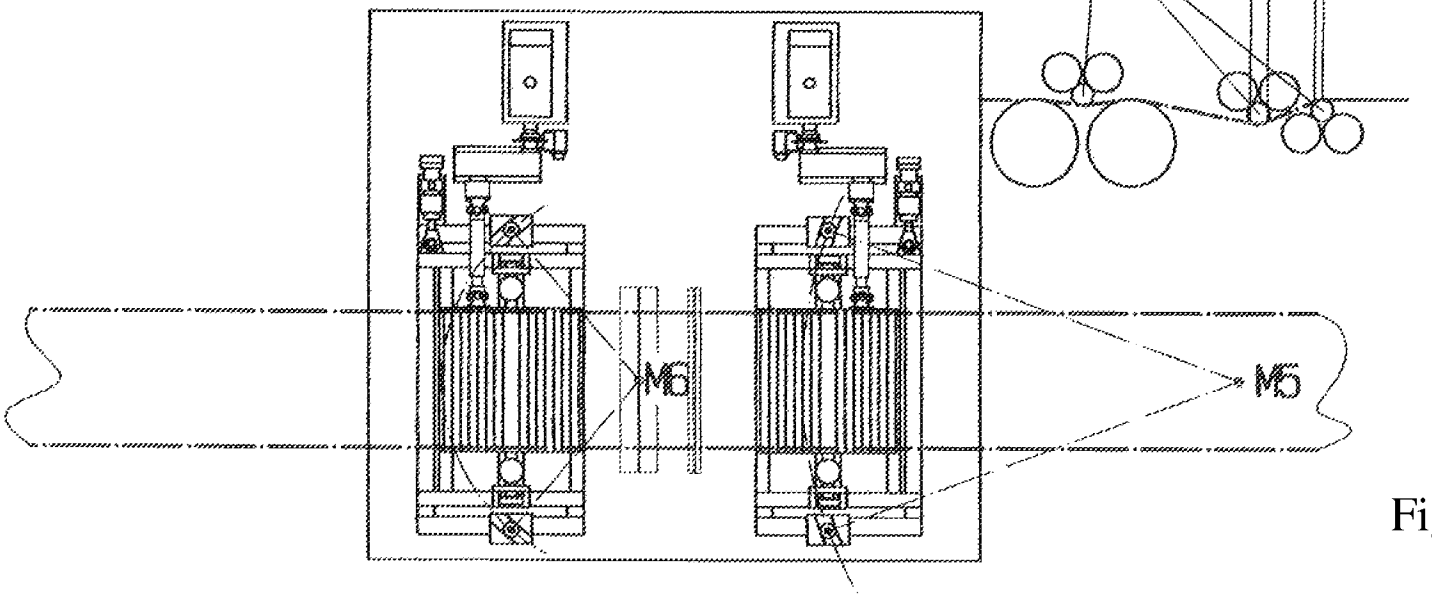
FIG. 6 is a top view of the system in FIG. 5.

In order to optimise costs, the strip tension can be reduced while the diameter of the bending rollers is simultaneously decreased for causing an increase in the level of deformation by the bending rollers. In FIGS. 5 and 6, a stretch-bend-stand 51 having considerably smaller bending rollers 52 is provided between the linear drive 6 on the inlet side and the linear drive 8 on the outlet side instead of a bending stand. During stretch-bend-straightening, the deformation is carried out in the region of the contact zone between the strip and the straightening rollers on 2-21 rollers.

With the stretch-bend stand 17 shown in FIGS. 5 and 6, stretching levels of for example 2% can be achieved having imposed strip tensions of about 10% of the material tensile yield strength×transverse section area of the strip. However, this leads to considerable residual stresses in the metal strip. Since strip tensions of up to 6,000 kN can be generated by the linear drives, an optimisation between costs and residual stresses is possible. The strip tension imposed by linear drives 6 and 8 is ideally at least 70% of the yield strength×transverse section of the strip, wherein yield strength here is taken to mean the 0.2% yield point in particular.

The advantages of an optimal strip guiding are also present in this exemplary embodiment.

Figure 7:
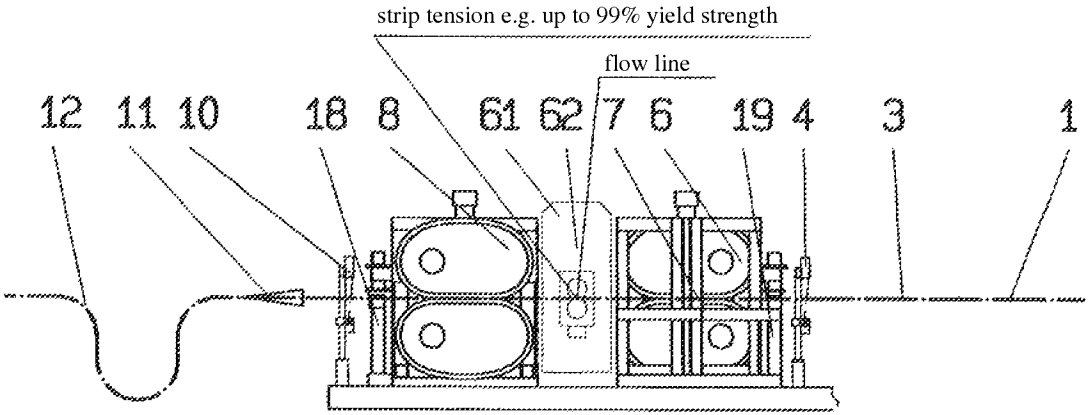
FIG. 7 is a side view of a system for straightening and rolling metal strips by means of strip tension supplemented by a roller mill unit in an operating position.
Figure 8:
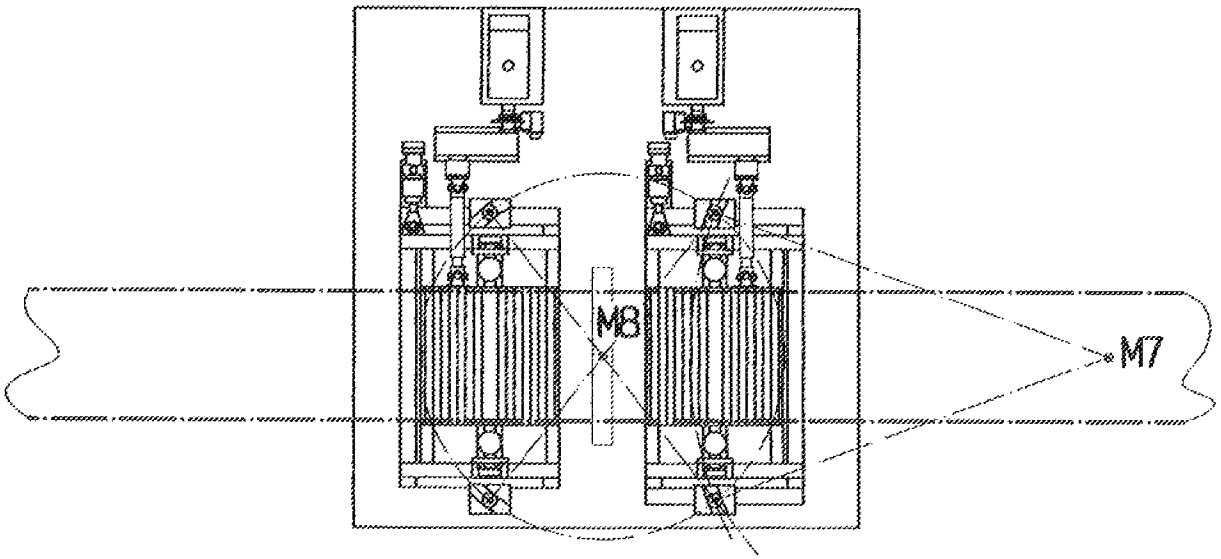
FIG. 8 is a top view of the system in FIG. 7.

In FIGS. 7 and 8, a rolling mill stand 61 having relatively large rollers 62 is provided between the linear drive 6 on the inlet side and the linear drive 8 on the outlet side instead of a bending stand. By way of example, the rollers 62 should typically cause a slight deformation of around 1% or less for example with a finishing thrust. At the same time, a strip tension of 99% of the yield strength×transverse section area of the strip is applied.

This exemplary embodiment has the advantage that the flow of the metal strip only occurs in the roll gap. Residual stresses are excluded as far as possible through the strip tension by means of linear drives without bending the strip in combination with rolling.

This exemplary embodiment further has the advantage that the strip path is regulated by the linear drive 6. A sabre reduction is achieved at the same time. The rollers offer a fixed point. The additional deformation to reduce the sabre is facilitated in this way. In order to optimise the cost, the strip tension can be reduced while the diameter of rolling is simultaneously decreased.

Depending on the desired structural composition and in relation to the constriction a strip tension of 50% of the yield strength×transverse section area of the strip can optionally be useful. A strip tension of 5,000 kN can easily be realised at a system speed of 50 m/min.

Figure 9:
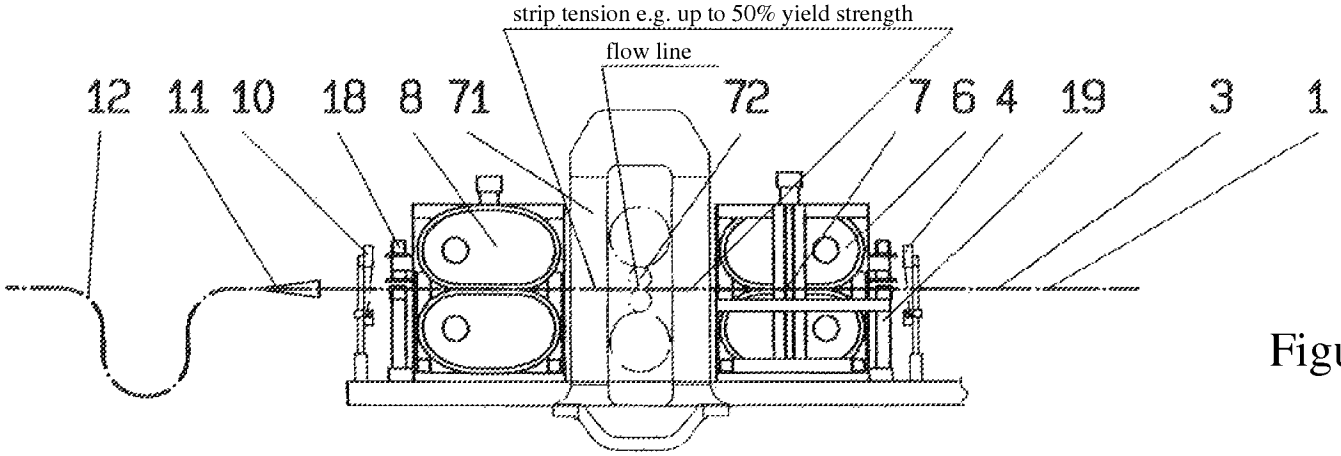
FIG. 9 is a side view of a system for straightening and rolling metal strips by means of strip tension supplemented by another roller mill unit in an operating position.
Figure 10:
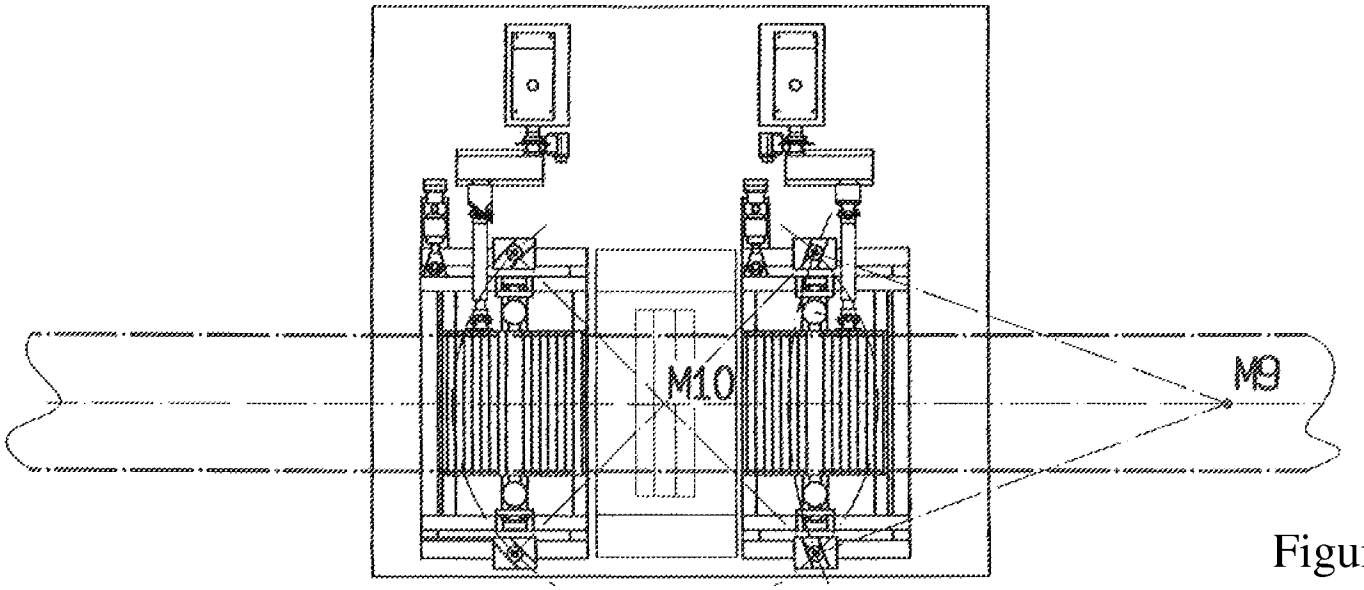
FIG. 10 is a top view of the system in FIG. 9.

The exemplary embodiments in FIGS. 9 and 10 differ from those in FIGS. 7 and 8 in that they have a rolling mill 71 with rollers 72, which rolling mill is designed for a considerably higher level of reduction of strip thickness of typically around 30%.

With the linear drive 6 on the inlet side and the linear drive 8 on the outlet side a very high strip tension can be generated on both sides of the rolling mill stand which can increase the deformation considerably. The deformation process can ideally be carried out such that straightening the strip in further processing steps for a part of strip manufacture is not necessary.

This exemplary embodiment also differs from those described above in that the linear drives 6 and 8 are pivotably mounted about a common centre of the circle M9. The centre of the circle M9 is in the centre of the roll gap between the two rollers 72.

The exemplary embodiment further has the advantage that the strip path is regulated by the linear drive 6. A sabre reduction is achieved at the same time. The rollers offer a fixed point. The additional deformation to reduce the sabre is facilitated in this way.

It should be noted in relation to the latter three exemplary embodiments that a strip guiding system after the roll gap or after the bending rollers enables a targeted correction of a sabre of the metal strip. This means that the strip sabre can be measured directly behind the straightening unit, if possible on the tension-free strip. The roll gap and the bending rollers are to be viewed as virtually a fixed point here. The short side of a sabre strip is impinged at a higher strip tension and therefore additionally stretched until a largely sabre-free metal strip remains. Checking of the strip sabre and the strip flatness is carried out on the outlet side of the linear drive on the outlet side if possible without tension or at a very low strip tension. The strip correction achieved by straightening can be readjusted by means of a strip guiding system and/or by changing the level of stretching.

Figure 11:
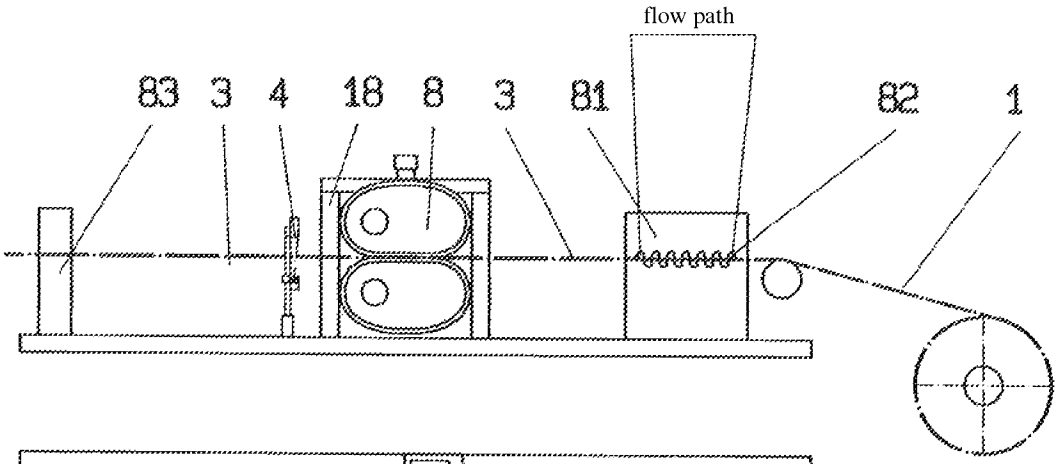
FIG. 11 is a side view of a system for stretch-bend-straightening metal strips in a transverse cut-to-length line by means of strip tension and straightening rollers which are as large as possible in an operating position.
Figure 12:
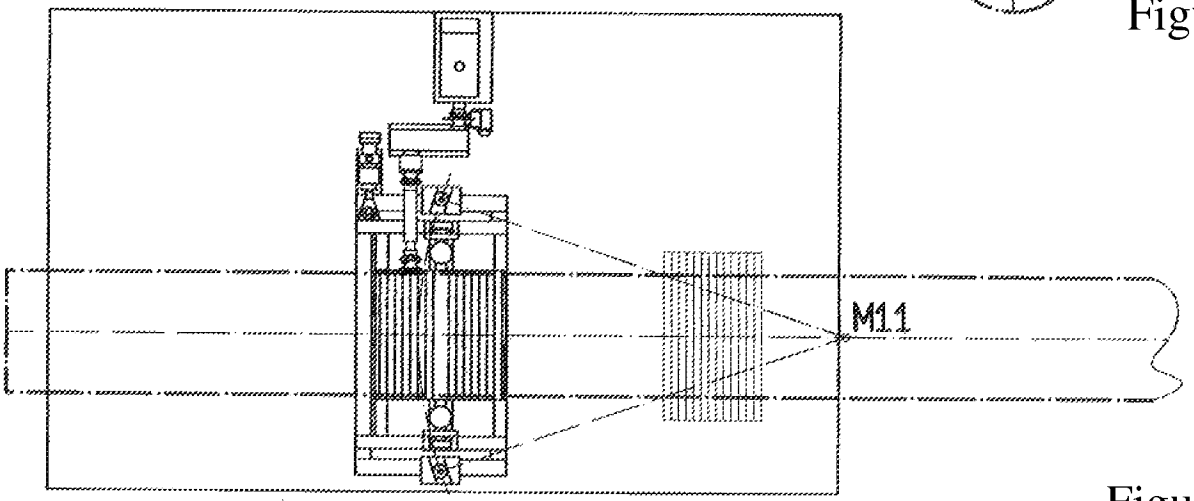
FIG. 12 is a top view of the system in FIG. 11.

FIGS. 11 and 12 show an exemplary embodiment according to the invention for a stretch-bend-straightening process, in the present example in a cut-to-length line. Only one linear drive 8 on the outlet side is present in this example, which linear drive 8 is arranged behind a straightening machine 81 with curving rollers 82 in the direction of movement of the strip 11. The linear drive 8 can be pivoted about a pivot point M11 which is arranged, in the direction of movement of the strip, before the linear drive 8. A cut-to-length shear 83 is arranged behind the linear drive 8.

This is a comparatively simple solution with limited effects. The retraction forces to stretch the metal strip must be applied by a decoiler 33 arranged in front of the straightening machine 31 and by the straightening machine 31 itself. The drives for the straightening machine 31 can be omitted if sufficient retraction force can be applied by the deformation action and the decoiler. The function of the straightening machine is in contrast to the diameters of the bending rollers mentioned previously having an as large as possible diameter in order to reduce possible residual stresses. This arrangement nevertheless has the advantage that the strip path is regulated by the linear drive 8. A sabre reduction is achieved at the same time. The straightening rollers offer a fixed point. The additional deformation to reduce the sabre is facilitated in this way.

A further advantage is that the metal strip can be fed to the cut-to-length shear 83 at exactly right angles using the strip guiding system.

The invention claimed is:

1. A device for straightening a metal strip, the device including:

a first strip drive configured to accept the metal strip as an input; and a second strip drive configured to accept as an input the metal strip that has been passed through the first strip drive, and which, in combination with the first strip drive, is configured to apply tension to the metal strip, wherein at least one of said first or second strip drives is a linear drive, wherein said linear drive has a positioning device configured to enable said linear drive to be moved in at least a transverse direction relative to a longitudinal axis along a direction of movement of the metal strip through the device between said first and second strip drives.

2. The device according to claim 1, wherein said linear drive comprises a first frame and an assembly frame, wherein said linear drive is mounted in the mounting a frame, and wherein the mounting frame is movably mounted within the assembly frame, and wherein the assembly frame comprises at least one guide and at least one guide element rigidly connected to said first frame, wherein the at least one guide is configured to interact with the at least one guide element such that said linear drive is movable relative to the assembly frame on a guided path defined by the at least one guide and the at least one guide element.

3. The device according to claim 2, wherein said guided path is a circular path.

4. The device according to claim 3, wherein a center point of a circle defined by said circular path is located in front of a side of the linear drive to which the metal strip is input, relative to the direction of movement of the metal strip through the device.

5. The device according to claim 1, wherein each of said two strip drives has a positioning device.

6. The device according to claim 1, wherein said first strip drive and said second strip drive are, respectively, first and second linear drives.

7. The device according to claim 6, wherein each of said first and second linear drives is configured to be movable on a circular path, relative to said longitudinal axis.

8. The device according to claim 6, further comprising at least one strip tension measuring device configured to measure a strip tension between said first and second linear drives.

9. The device according to claim 8, wherein measurement data determined by said strip tension measuring device is used to control said positioning device.

10. The device according to claim 6, further comprising at least one measuring device configured to determine one or a plurality of properties of said metal strip, the one or a plurality of properties of said metal strip including one or more properties selected from the group consisting of a cross section of the metal strip, a waviness of the metal strip and a position of the metal strip.

11. The device according to claim 10, wherein measurement data determined by said measuring device are used to control the positioning device of said first linear drive, said second linear drive, or both.

12. The device according to claim 6, further comprising a rolling mill stand arranged between said first and second linear drives.

13. The device according to claim 12, wherein said two linear drives are pivotable along a common circular path, wherein a center of the circular path is in a middle of a roll gap of said rolling mill stand.

14. The device according to claim 12, wherein the rolling mill stand is configured to apply a deformation of less than 1% to the metal strip.

15. The device according to claim 6, further comprising at least one bending roller arranged between said first and second linear drives.

16. The device according to claim 15, wherein the at least one bending roller has a diameter whose ratio to a thickness of the metal strip is at least 500:1.

17. A device for straightening a metal strip, the device including:

a first linear drive on a side of the device configured to input the metal strip;

a second linear drive on a side of the device configured to output the metal strip after straightening; and a deforming stand arranged between said first and second linear drives and configured to apply a deformation to the metal strip between said first and second linear drives, wherein the first and second linear drives are configured together to apply tension to said metal strip to straighten said metal strip.

18. The device according to claim 17, wherein the deforming stand is configured to apply a deformation of less than 1% to the metal strip.

19. The device according to claim 18, wherein the deforming stand comprises a roll stand or a bending stand.

* * * * *